US005938370A

United States Patent [19]

Gzybowski

[11] Patent Number: 5,938,370

[45] Date of Patent: Aug. 17, 1999

[54] SAFETY BARRIER WITH PASSAGEWAY

[76] Inventor: Michael S. Gzybowski, P.O. Box 13381, Fort Wayne, Ind. 46868-3381

[21] Appl. No.: 09/159,260

[22] Filed: Sep. 23, 1998

[51] Int. Cl.[6] ..... G01F 13/00

[52] U.S. Cl. ..... 404/6; 404/9

[58] Field of Search ..... 404/6, 9

[56] References Cited

U.S. PATENT DOCUMENTS

| | | | |
|---|---|---|---|
| 5,011,325 | 4/1991 | Antonioli | 404/6 |
| 5,022,781 | 6/1991 | Smith | 404/6 |
| 5,137,391 | 8/1992 | Ballesteros . | |
| 5,531,540 | 7/1996 | Wasserstrom et al. | 404/6 |
| 5,641,241 | 6/1997 | Rushing | 404/6 |

*Primary Examiner*—Thomas B. Will
*Assistant Examiner*—Raymond W Addie
*Attorney, Agent, or Firm*—Michael S. Gzybowski

[57] ABSTRACT

Safety barriers for directing and separating traffic on roads, highways and construction sites which include through-holes or passageways for animals to pass through. The through-holes or passageways are configured so that distal edges of the through-hole or passageway openings downstream from traffic flow are obtusely angled with respect to adjacent sides of the barriers, and thereby able to deflect vehicles which might strike the barriers at the openings. The through-holes or passageways allow small animals to pass through the barriers and thereby escape being struck by vehicles. The through-holes or passageways can include sloped bottoms to prevent animals from nesting therein.

14 Claims, 6 Drawing Sheets

FIGURE 1
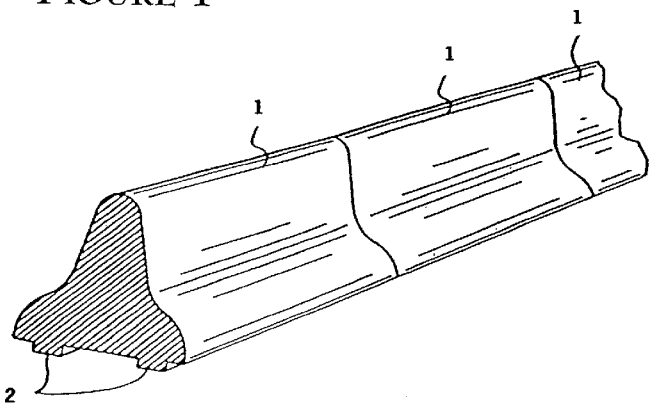
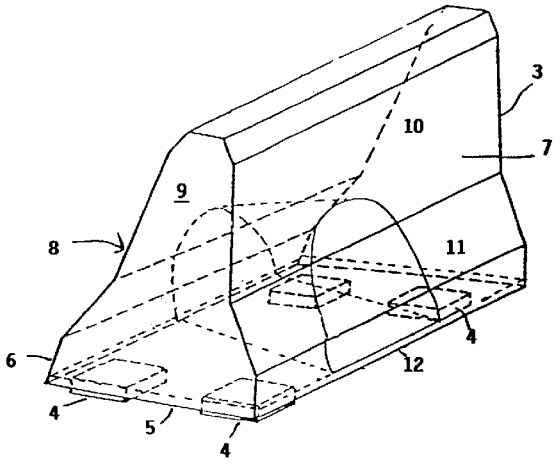
FIGURE 2a
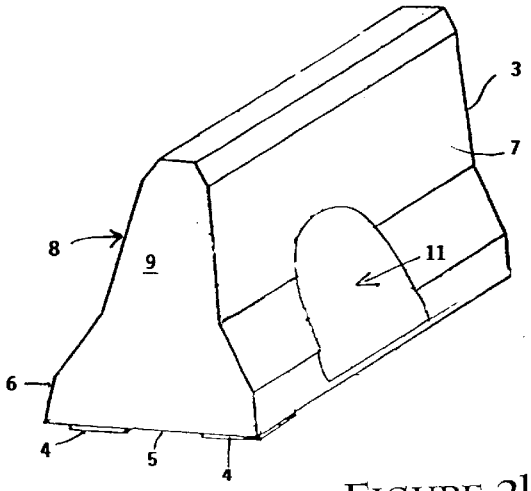
FIGURE 2b

FIGURE 7
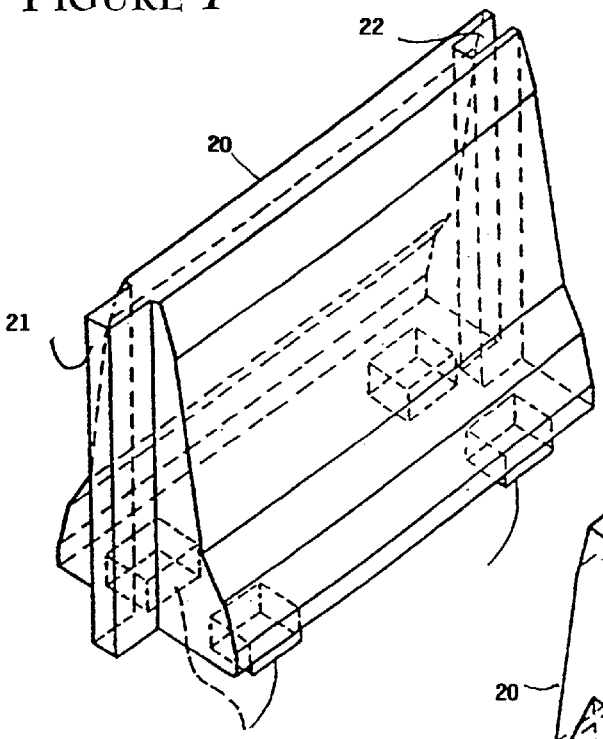
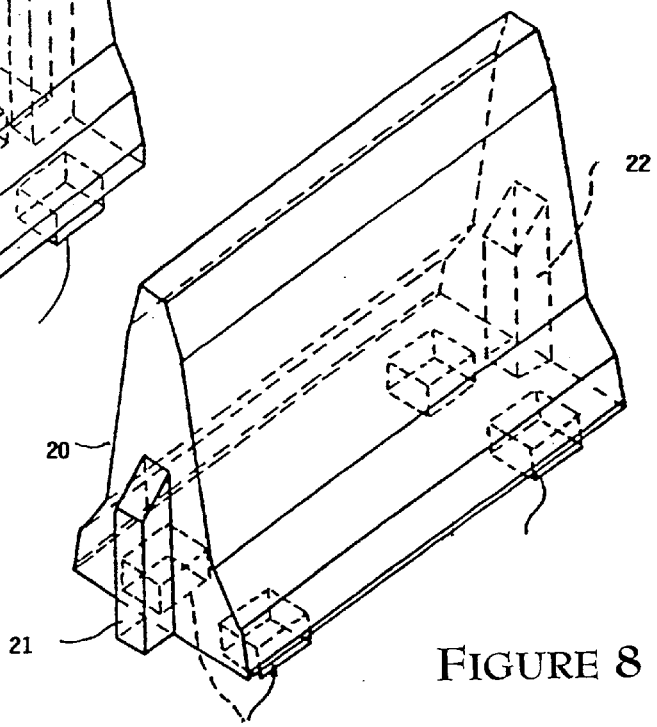
FIGURE 8
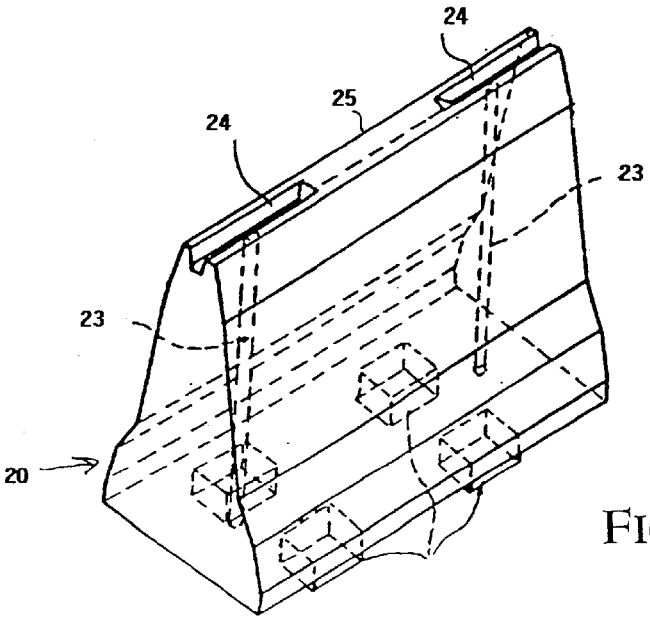
FIGURE 9

SAFETY BARRIER WITH PASSAGEWAY

TECHNICAL FIELD

The present invention relates to safety barriers for roads and highways and similar barricades. More particularly, the present invention relates to safety barriers and barricades which have passageways through which small animals can pass.

BACKGROUND ART

Safety barriers are often used to separate opposite traffic ways when there is not enough space to provide a medium therebetween. More commonly, safety barriers are used during the construction of streets, roads and highways to redirect and separate opposite traffic ways. For example, when repairing dual lane divided highways, it is common to redirect traffic to one side of the medium and separate traffic moving in opposing directions by a continuous line or row of concrete barriers which are placed end-to-end and coupled together.

In rural areas, small animals such as racoons, opossums, foxes, etc. may wonder across roads and highways at regular crossing points. When barriers are positioned along such roads and highways, the small animals can become trapped in traffic lanes and killed. These animals may be unfamiliar with or unsuspecting of such barriers while merely attempting to cross roads and highways at points that they have concluded to be safe, based upon past crossing experiences. The present inventor has noted unusually high numbers of dead animals on highways immediately after barriers have been installed. Similar problems can also occur in urban areas where squirrels, pets and other small domestic and non-domestic animals habitually cross streets and roads.

The present invention provides barrier and barricade structures which include passageways through which small animals can pass, and thereby avoid being struck and killed by vehicular traffic.

DISCLOSURE OF THE INVENTION

According to various features, characteristics and embodiments of the present invention which will become apparent as the description thereof proceeds, the present invention provides an improvement over safety barriers for containing vehicles to traffic lanes, which safety barriers include a central axis, a base, opposed ends, and opposed sides which are substantially parallel to the central axis, the improvement includes:

a passageway extending through the barrier and defining openings thereof at each of the opposed sides, the passageway having a diameter which is sufficiently large to allow a small animal to pass therethrough, at least a peripheral portion of the passageway which defines an edge of the openings having an angle which is obtuse to an adjacent side of the barrier.

The present invention further provides a safety barrier which includes:

a solid cast body having a base, a central axis, opposed sides which are substantially parallel to the central axis, and opposed ends; and a passageway extending through the barrier and defining openings thereof at each of the opposed sides, the passageway having a diameter which is sufficiently large to allow a small animal to pass therethrough, at least a peripheral portion of the passageway which defines an edge of the openings having an angle which is obtuse to an adjacent side of the barrier.

The present invention also provides a method of installing a safety barrier along a vehicular traffic lane which includes passageways for small animals to pass therethrough and escape being struck by traffic, which method involves:

providing a plurality of first barrier elements each having a base, a central axis, continuous opposed sides which are substantially parallel to the central axis, and opposed ends;

providing a plurality of second barrier elements each having a base, a central axis, opposed sides which are substantially parallel to the central axis, opposed ends and passageways extending though the second barrier elements and defining openings thereof at the opposites sides, the passageway openings forming obtuse angles with respect to an adjacent side of the second barrier elements; and aligning the first and second barrier elements end to end to form a safety barrier along a vehicular traffic lane.

BRIEF DESCRIPTION OF DRAWINGS

The present invention will be described with reference to the attached drawing which are given as non-limiting examples only, in which:

FIG. 1 is a perspective view of a group of conventional barriers which are arranged in a line.

FIG. 2*a* is a perspective view of a barrier according to one embodiment of the present invention.

FIG. 2*b* is similar to FIG. 2*b* with the hidden contour lines removed.

FIG. 7 is a perspective view of an alternative embodiment of a barrier according to the prior art of U.S. Pat. No. 5,137,391 to Ballesteros.

FIG. 8 is a perspective view of an alternative embodiment of a barrier according to the prior art of U.S. Pat. No. 5,137,391 to Ballesteros.

FIG. 9 is a perspective view of an alternative embodiment of a barrier according to the prior art of U.S. Pat. No. 5,137,391 to Ballesteros.

BEST MODE FOR CARRYING OUT THE INVENTION

Figure 3A:
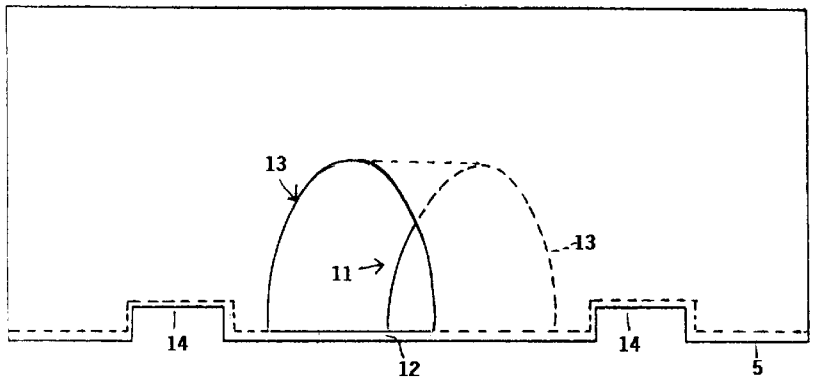
FIG. 3*a* is a side view of the barrier of FIG. 2*a*.

The present invention relates to safety barriers for roads and highways and similar barricades. More particularly, the present invention relates to safety barriers and barricades which have passageways therein through which small animals can pass. The barriers of the present invention can be of conventional size and can be made out of concrete, which can be reinforced, or can be in the form of molds that are filled with water, sand or other suitable ballast material. The barriers can be designed so that they can be coupled to one another end-to-end in a conventional manner. The barriers can be provided with pads or feet on their bottoms to allow for surface water drainage. Alternatively, the barriers can include channels in their bottoms to allow for surface water drainage. In addition to allowing for surface water drainage, pads, feet, channels, and similar structures can allow the barriers to be lifted and moved by fork trucks, hand carts, pry bars, etc.

The barriers of the present invention are provided with through-holes or passageways which extend between the sides thereof. The through-holes or passageways are designed so as to deflect vehicles which may unintentionally hit the barrier. In this regard, the through-holes or passageways are provided with surfaces that are non-perpendicular to the sides of the barrier. According to one embodiment, the central axes of the passageways can be perpendicular to the sides of the barriers and the outer edges of the passageways can be angled or curved so as not to be perpendicular to the sides of the barriers. In other embodiments, the central axes of the passageways are non-perpendicular to the sides of the barriers.

The passageways can have any convenient cross-sectional shape, including, but not limited to, square, circular, half-round, ovular, half-ovular, triangular, etc. According to one embodiment, the bottoms of the passageways can be ramped or sloped so as to have a central peak or slant in order to discourage animals from nesting in the passageways. The passageways are preferably sized so as to allow small animals such as racoons, opossums, foxes, squires, pets, etc. to be able to pass therethrough. Thus, the passageways can have diameters of approximately 4 to 12 inches or larger.

The passageways can be positioned near the bottoms of the barriers so that they can be located by small animals that are searching for a way through or around the barriers. In the case of molded barriers, e.g. concrete barriers, reinforcing rods, plates, braces, etc. may be included to strengthen the structure of the barrier near or around the passageways. In such cases, reinforcing rods or reinforcing plates or braces can be provided beneath or around the passageways. According to one embodiment of the present invention the inner surfaces of the passageways can be provided with a dark color. For example, the inner surfaces of the passageways can be painted black, in order for small animals to be attracted to the passageways more quickly when they are in the path of an vehicle. In this regard, animals will instinctively try to escape in burrows or other dark places where they can hide.

Although the barriers of the present invention can be used and coupled together to separate lengths of traffic ways, they can also be used with convention barriers. That is, the barriers of the present invention can be interspersed with any number of conventional barriers that do not have passageways so as to provide a length of coupled barriers which has passageways spaced therealong as desired. In some instances, it may be sufficient to provide barrier sections having passageways at selected portions or areas of a highway or road where animals are more likely to cross, such as low-lying wooded areas and areas near sources of water and/or food.

FIG. 1 is a perspective view of a group of conventional barriers which are arranged in a line. As depicted, the barriers 1 comprise solid concrete structures which have a generally triangular shaped cross-section with a widened base. The bottom of the base can include feet or pads 2 which support the base. The barriers can be coupled or linked together to form a continuous structure as depicted.

FIG. 2*a* is a perspective view of a barrier according to one embodiment of the present invention. The barrier 3 of FIG. 2*a* (and those throughout the figures) is preferably a solid structure. The broken lines are included to illustrate possible contours of the sides of the barrier and feet or pads 4 which can be provided to support the barrier 3. As an alternative to the use of feet or pads 4, channels or other structure can be provided in the bottom 5 of the barrier 3 to provide for surface water drainage beneath the barrier 3. As depicted in FIG. 2*a* the barrier 3 has a generally triangular shape with a wider base portion 6. The barrier has opposed sides 7, 8 and opposed ends 9, 10. As indicated in FIG. 2*a*, the transition in width between the base portion 6 and upper sides of the barrier 3 should be free of any abrupt angular changes In this regard, the sides of the barrier 3 should be designed to guide or deflect a vehicle that strikes the barrier at an angle (other than perpendicular) and not catch or suddenly stop such a vehicle or cause the vehicle to roll over. Thus, in the vertical direction, the sides of the barrier should have curved transitional portions or transitional portions with large angular shapes. As depicted, the top edges of the sides 7, 8 of the barrier 3 can be beveled if desired.

The barrier 3 is provided with a through-hole or passageway 11 that extends through both sides 7, 8 of the barrier 3. According to one embodiment as depicted in FIG. 2*a*, the through-hole or passageway 11 has a central axis which is non-perpendicular with the central axis of the barrier 3. It has been determined that having the through-hole or passageway 11 non-perpendicular with respect to the central axis of the barrier 3 can avoid sharp edges at the distal edges of the through-hole or passageway 11. Herein the reference to the "proximal" and "distal" edges of the through-holes or passageways 11 is made in reference to the direction at which traffic moves adjacent the barriers 3. The edges of the through-holes or passageways 11 or edges of the openings thereof which are upstream with respect to adjacent traffic flow are referred to herein as the proximal edges and the corresponding edges with are downstream with respect to adjacent traffic flow are referred to herein as the distal edges. It is noted that since traffic flow is generally in opposite directions on either side of the barriers 3, the use of a angled, non-perpendicular through-holes or passageways 11 will provide proximal and distal edges which have corresponding obtuse angular shapes on either side of the barriers 3.

The through-holes or passageways 11 should have a size which is sufficient to allow small animals to pass therethrough. In has been determined that through-holes or passageways having a diameter of approximately 4 to 12 inches or larger should allow small animals to pass therethrough. The distal edges of the through-holes or passageways 11 should form obtuse angles with the sides 7, 8 of the barriers 3 in order to deflect rather than catch or engage and abruptly arrest the motion of a vehicle which accidentally strikes distal edges. In further embodiments of the present invention which are discussed below, the peripheral portions of the distal edges of the through-holes or passageways can be obtusely angled with respect to the sides 7, 8 of the barriers.

Although FIG. 2*a* depicts a through-hole or passageway 11 having a arched-shape cross-section, it will be understood from the following disclosure that the through-holes or passageways 11 can have a variety of cross-sectional shapes.

FIG. 2*a* depicts a reinforcement element 12 which extends beneath the through-hole or passageway 11. Reinforcement element 12 can comprise one or more plates, rods, braces, etc, which reinforce the molded barrier 3 so that the through-hole or passageways 11 do not adversely compromise the strength of the barriers 3.

FIG. 2*b* is similar to FIG. 2*a* with the hidden contour lines removed.

FIG. 3*a* is a side view of the barrier of FIG. 2*a* which depicts how the openings 13 of the through-hole or passageway 11 are not aligned perpendicularly across the width of the barrier 3. Also depicted in FIG. 3*a* are channels 14 that are provided in the bottom 5 of the barrier 3, and a lower reinforcement element 12. It is to be understood that other reinforcement elements 12 could be provided in the barrier 3 adjacent the through-hole or passageway 11.

Figure 3C:
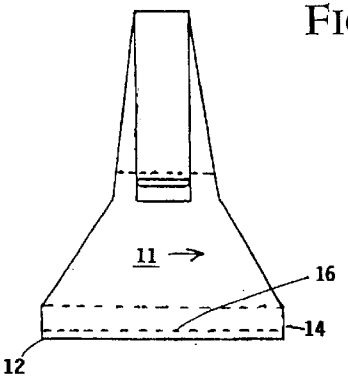
FIG. 3*c* is an end view of the barrier of FIG. 2*a*.
Figure 3B:
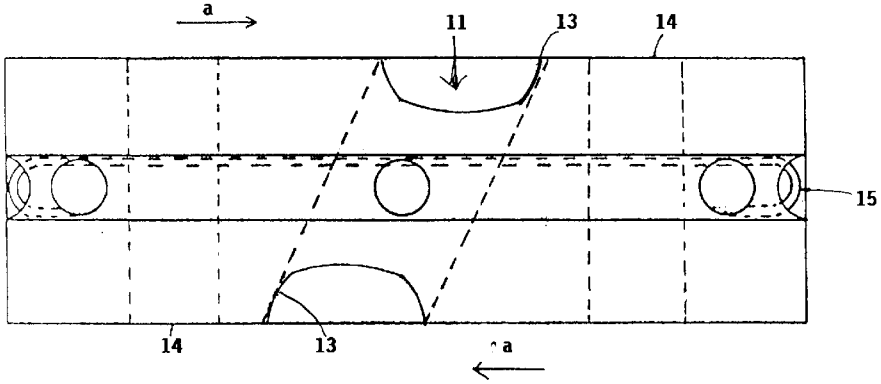
FIG. 3*b* is a top view of the barrier of FIG. 2*a*.

FIG. 3*b* is a top view of the barrier of FIG. 2*a* which depicts the manner in which the central axis of the through-hole or passageway 11 is angled with respect to the central axis of the barrier 3. In FIG. 3*b*, the direction of traffic flow is depicted by arrows "a." As can be seen, the distal edges of the through-hole or passageway 11 on either side of the barrier 3 have obtuse angles and thereby can deflect vehicles which strike the distal edges. Obtuse angles of about 110° to about 150° or greater are useful for purposes of the present invention.

In FIG. 3*b* a conventional coupling structure used to pin or couple adjacent barrier structures is indicated by reference numeral 15. This structure includes reinforced hook elements which can receive rods, bolts, or pins which are used to couple adjacent barriers together in a known manner.

Figure 3D:
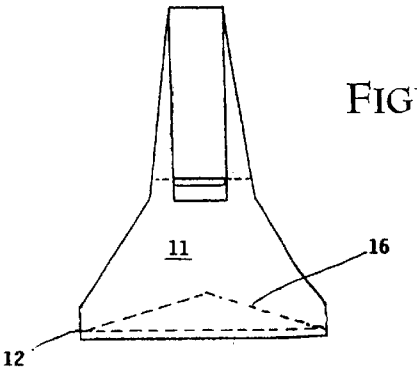
FIG. 3*d* is an end view of an alternative embodiment of a through-hole for a barrier according to the present invention.

FIG. 3*c* is an end view of the barrier of FIG. 2*a*. FIG. 3*d* is an end view of an alternative embodiment of a through-hole for a barrier according to the present invention. FIG. 3*d* depicts the bottom 16 of the through-hole or passageway 11 as being sloped so as to form a crown at a middled portion thereof. Providing the bottom 16 of the through-hole or passageway 11 with a ramped, sloped, roughened or other non-level shape will discourage animals from nesting therein. The bottom can be ramped or sloped in any direction.

Figure 4C:
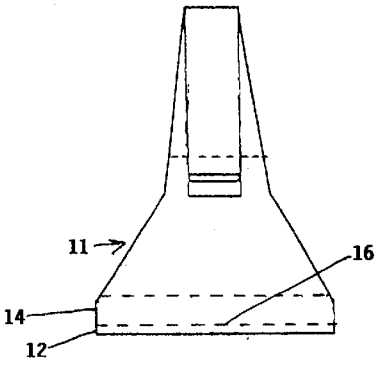
FIG. 4*c* is an end view of the barrier of FIG. 4*a*.
Figure 4A:
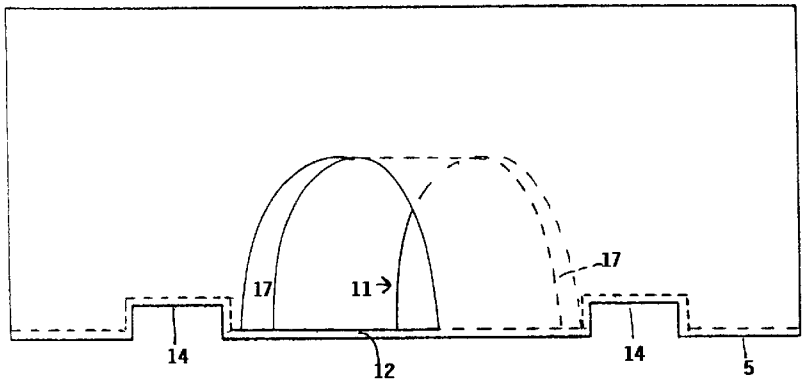
FIG. 4*a* is a side view of a barrier according to another embodiment of the present invention.
Figure 4B:
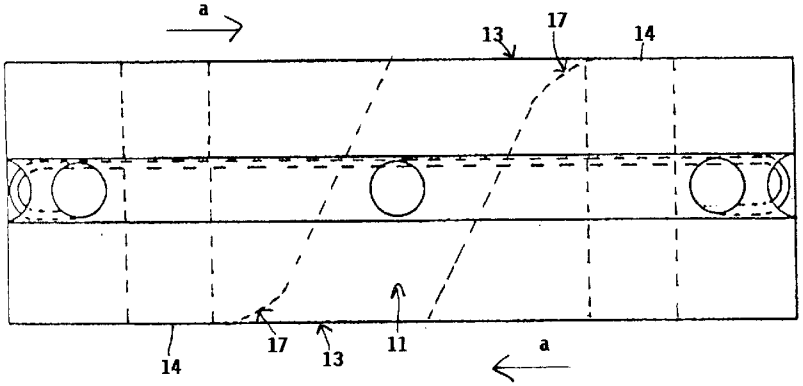
FIG. 4*b* is a top view of the barrier of FIG. 4*a*.

FIG. 4*a* is a side view of a barrier according to another embodiment of the present invention. FIG. 4*b* is a top view of the barrier of FIG. 4*a*. FIG. 4*c* is an end view of the barrier of FIG. 4*a*. In the embodiment of the invention exemplified by FIGS. 4*a*–4*c*, the through-hole or passageway 11 has peripheral portions 17 on the distal edges which are curved obtusely with respect to the sides 7, 8 of the barrier 3. In an alternative embodiment, the curved peripheral portions can be replaced with more obtusely angled peripheral portions. Such curved or obtusely angled or compound angled peripheral edge portions can also be used in conjunction with through-holes or passageway 11 which are provided perpendicular to the central axis of the barriers 3.

Figure 5C:
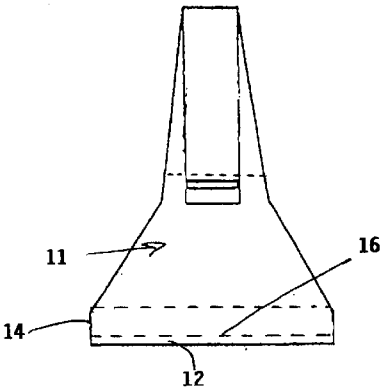
FIG. 5*c* is an end view of the barrier of FIG. 5*a*.
Figure 5A:
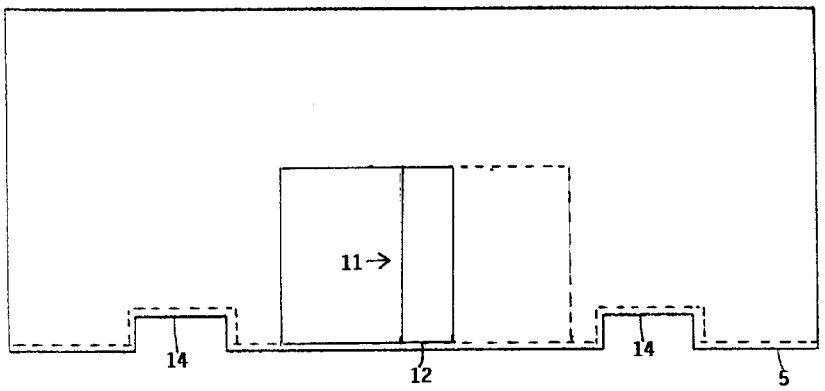
FIG. 5*a* is a side view of a barrier according to another embodiment of the present invention.
Figure 5B:
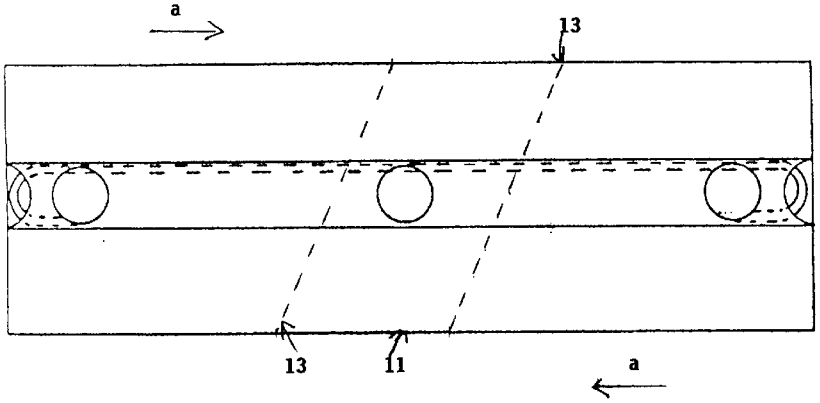
FIG. 5*b* is a top view of the barrier of FIG. 5*a*.

FIG. 5*a* is a side view of a barrier according to another embodiment of the present invention. FIG. 5*b* is a top view of the barrier of FIG. 5*a*. FIG. 5*c* is an end view of the barrier of FIG. 5*a*. The embodiment of the invention exemplified in FIGS. 5*a*–5*c* includes a through-hole or passageway 11 which has a rectangular cross-section.

Figure 6C:
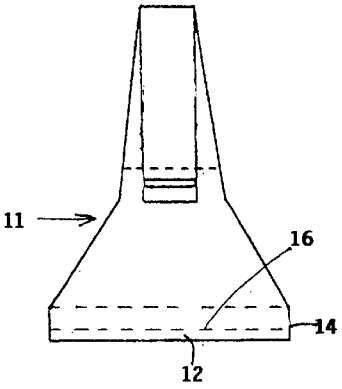
FIG. 6*c* is an end view of the barrier of FIG. 6*a*.
Figure 6A:
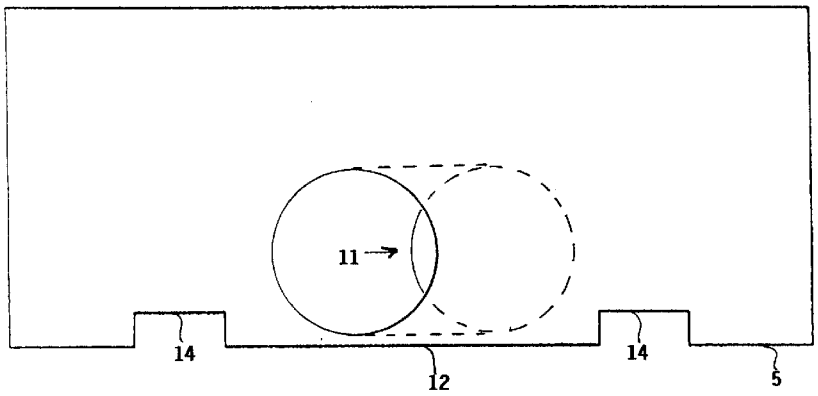
FIG. 6*a* is a side view of a barrier according to another embodiment of the present invention.
Figure 6B:
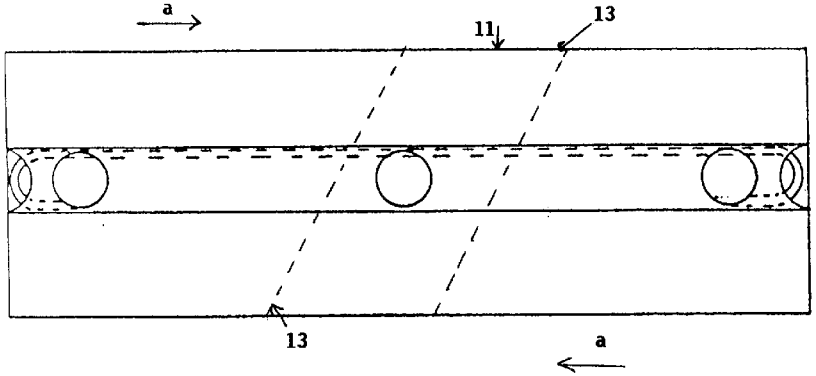
FIG. 6*b* is a top view of the barrier of FIG. 6*a*.

FIG. 6*a* is a side view of a barrier according to another embodiment of the present invention. FIG. 6*b* is a top view of the barrier of FIG. 6*a*. FIG. 6*c* is an end view of the barrier of FIG. 6*a*. The embodiment of the invention exemplified in FIG. 6*a*–6*c* includes a through-hole or passageway 11 which has a circular cross-section.

FIGS. 7–9 depict conventional barriers and are included to depict alternative coupling arrangements which can be used in conjunction with the barriers of the present invention.

FIG. 7 is a perspective view of an alternative embodiment of a barrier having coupling structure at opposite ends thereof. FIG. 8 is a perspective view of an alternative embodiment of a barrier having coupling structure at opposite ends thereof. FIG. 9 is a perspective view of an alternative embodiment of a barrier having coupling structure at opposite ends thereof.

FIG. 7 depicts a barrier 20 which includes a projection 21 on one end and a complementarily shaped recess 22 on an opposite end. In this embodiment, corresponding projections 21 and recesses 22 on adjacent barriers 20 can be engaged to couple the barriers 20 together.

FIG. 8 depicts a barrier 20 which includes a shorter projection 21 on one end and a complementarily shaped recess 22 on an opposite end. In this embodiment corresponding projections 21 and recesses 22 on adjacent barriers 20 can be engaged to couple the barriers 20 together.

FIG. 9 depicts a barrier with threaded rods 23 which are molded in the barrier 3 so as to extend within recessed portions 24 at the top 25 of the barrier 20. Adjacent barriers 20 can be coupled together by braces or coupling elements (not shown) which can be coupled to the threaded rods 23 by nuts or other mechanical fasteners.

It is to be understood that the barriers of the present invention can incorporate and use any conventional means to couple adjacent barriers together.

Although the present invention has been described with reference to particular means, materials and embodiments, from the foregoing description, one skilled in the art can easily ascertain the essential characteristics of the present invention and various changes and modifications can be made to adapt the various uses and characteristics without departing from the spirit and scope of the present invention as described above.

What is claimed is:

1. A safety barrier which comprises:

a solid body having a base, a central axis, opposed sides which are substantially parallel to the central axis, opposed ends, and a bottom; and a passageway adjacent the bottom of the solid body and extending through the barrier and defining openings thereof at each of the opposed sides, the passageway having a diameter of at least approximately 4 inches and a central axis which is non-perpendicular to the central axis of the solid body.

2. A safety barrier according to claim 1, wherein the passageway has a bottom which is adjacent to a bottom of the barrier.

3. A safety barrier according to claim 2, wherein the bottom of the passageway is substantially level.

4. A safety barrier according to claim 2, wherein the bottom of the passageway has a sloped portion.

5. A safety barrier according to claim 1, wherein the barrier includes end structures for coupling adjacent barriers together.

6. A safety barrier according to claim 1, wherein the passageway has a diameter in the range of about 4 to about 12 inches.

7. A safety barrier according to claim 1, wherein the passageway has an arched cross-sectional shape.

8. A safety barrier according to claim 1, wherein the passageway has a circular cross-sectional shape.

9. A safety barrier according to claim 1, wherein the passageway has a rectangular cross-sectional shape.

10. A safety barrier according to claim 1, further comprising at least one reinforcing element in said barrier body.

11. A safety barrier according to claim 1, wherein opposite edges of the openings on either side of the barrier have peripheral portions which are curved.

12. A safety barrier according to claim 1, wherein the passageway has a diameter which is at least 12 inches.

13. A method of installing a safety barrier along a vehicular traffic lane which includes passageways for small animals to pass therethrough and escape being struck by traffic, which method comprises:

providing a plurality of first barrier elements each having a base, a central axis, continuous opposed sides which are substantially parallel to the central axis, and opposed ends;

providing a plurality of second barrier elements each having a base, a central axis, opposed sides which are substantially parallel to the central axis, opposed ends, a bottom and a passageway adjacent the bottom, the passageway having a central axis which is non-perpendicular to the central axis and which extends though the second barrier element and defines openings thereof at the opposites sides; and aligning the first and second barrier elements end to end to form a safety barrier along a vehicular traffic lane.

14. A method of installing a safety barrier according to claim 13, further comprising coupling adjacent ones of said first and second barrier elements together.

* * * * *